US008474427B2

(12) United States Patent
Dorn et al.

(10) Patent No.: US 8,474,427 B2
(45) Date of Patent: Jul. 2, 2013

(54) TAPPET

(75) Inventors: Stefan Dorn, Hollfeld (DE); Norbert Geyer, Hochstadt (DE); Karsten Kucht, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 191 days.

(21) Appl. No.: 13/142,370

(22) PCT Filed: Mar. 4, 2010

(86) PCT No.: PCT/EP2010/052742

§ 371 (c)(1),
(2), (4) Date: Jun. 27, 2011

(87) PCT Pub. No.: WO2010/102942

PCT Pub. Date: Sep. 16, 2010

(65) Prior Publication Data

US 2011/0265752 A1 Nov. 3, 2011

(30) Foreign Application Priority Data

Mar. 13, 2009 (DE) ..... 10 2009 013 130

(51) Int. Cl.
*F01L 1/14* (2006.01)

(52) U.S. Cl.
USPC ..... 123/90.48; 123/90.5; 123/90.52; 74/569

(58) Field of Classification Search
USPC ..... 123/90.48, 90.5, 90.52; 74/567, 74/569
See application file for complete search history.

(56) References Cited

U.S. PATENT DOCUMENTS

| | | | | |
|---|---|---|---|---|
| 5,379,730 | A | 1/1995 | Schaeffler | |
| 8,235,018 | B2 * | 8/2012 | Dorn et al. | 123/90.48 |

FOREIGN PATENT DOCUMENTS

| | | |
|---|---|---|
| DE | 4209440 | 9/1993 |
| DE | 4403510 | 8/1995 |
| DE | 102004056458 | 6/2006 |
| DE | 102006057246 | 6/2008 |

* cited by examiner

*Primary Examiner* — Ching Chang
(74) *Attorney, Agent, or Firm* — Volpe and Koenig, P.C.

(57) ABSTRACT

A tappet (1) for a high-pressure fuel pump having a housing (2), the drive input side (7), which serves as a cam run-on face. The housing (2) incorporates a roller (8), wherein the drive output side (3), which serves as a contact surface for a tappet follower part, of said housing (2) bears against an underside (4) of a bridge piece (6) which projects through an inner casing (5) of the housing (2), and a rotation prevention device (11) which projects beyond the outer casing (10) of the housing (2) extends in a window (9) of the housing (2). The rotation prevention device (11) is formed by a radial elongation of the bridge piece (6). A projection extends from the inner casing (5) of the tappet (1) only on a portion situated diametrically opposite the window (7), which projection is integrally connected and is produced by a punching and embossing process and rises in a wedge shape in a direction of the drive input side. The section (13) of the sheet-steel bridge piece (6) which is situated diametrically opposite the radial elongation (12) is snapped over the projection (15), and this section (13) rests with an edge region (14) of the underside (4) thereof on said projection (15).

8 Claims, 2 Drawing Sheets

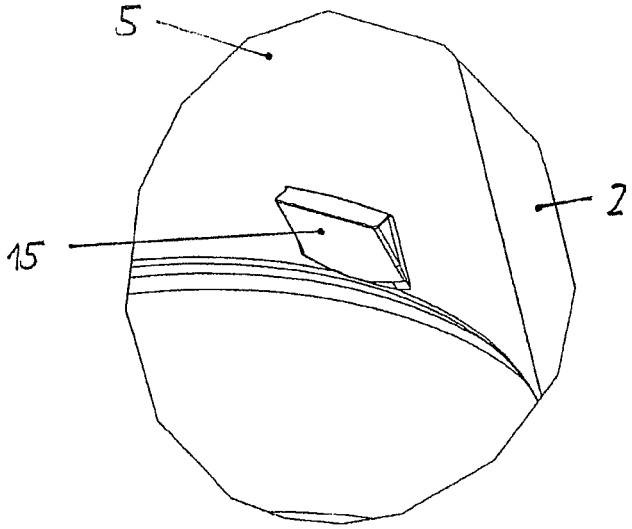
Fig. 3
Fig. 4
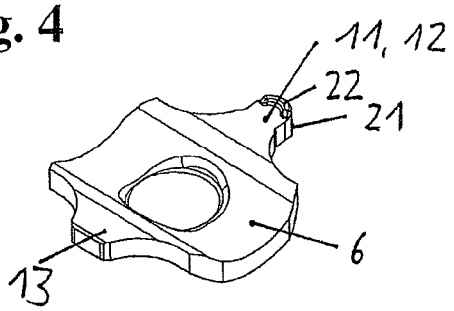
Fig. 5
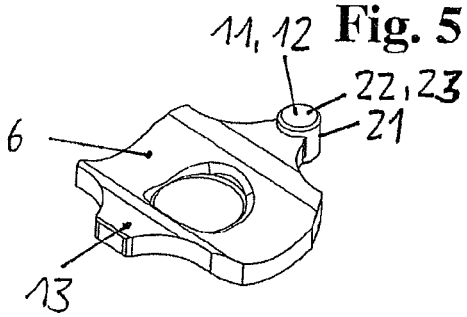
Fig. 6
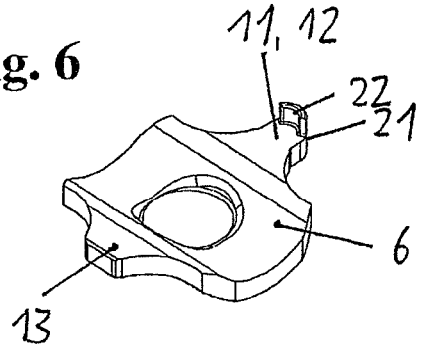
Fig. 7
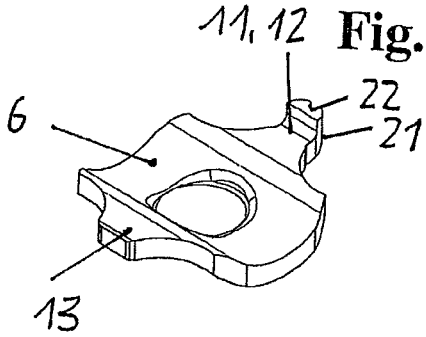

TAPPET

FIELD OF THE INVENTION

The invention relates to a tappet, either for a high-pressure fuel pump or for a valve train of an internal combustion engine that is regulated in quality or quantity, with a housing, wherein a roller or sliding surface is incorporated in its drive side used for a cam or eccentric catch and wherein its driven side that is used for contact of a tappet follower lies on a bottom side of a bridge part extending through an inner casing of the housing, wherein an anti-rotation device that projects past its outer casing and formed from a radial extension of the bridge part extends into a window of the housing.

BACKGROUND

Such a tappet, here for lift actuation of a pump piston of a fuel pump, emerges from DE 10 2006 057 246 A1. As an anti-rotation device for its housing, a radial extension of its bridge part is used that extends through a window of the housing (see FIGS. 1*a*-1*c*). The bridge part is held on a ring element in the direction of the driven side, with this ring element sitting on tabs that are distributed peripherally and projecting from the inner casing of the housing.

Due to the separate retaining ring and also the peripheral tabs, increased material and assembly costs are to be expected.

SUMMARY

The object of the invention is therefore to create a tappet of the type noted above in which the listed disadvantages are overcome.

According to the invention, this objective is met in that an integrally attached projection that is produced by a stamping-embossing process and rises with a wedge shape in the direction toward the drive side extends on the inner casing of the tappet only at one section diametrically opposite the window, wherein the bridge part made from steel sheet metal is snapped over the projection with its section diametrically opposite the radial extension and lies on this projection with an edge area of its bottom side.

Thus, a tappet is realized in which the disadvantages described above are eliminated. The bridge part snapped behind the projection thus experiences, in the direction toward the driven side, a two-point support in the window and on the projection. Possibly, two slightly spaced apart projections could also be applied to the window on opposite sides. Due to the elimination of the separate retaining ring according to the prior art, the number of parts and also the assembly effort are reduced. The bridge part is mounted in the finished state of the tappet, i.e., after a hardening and polishing process, and finally extends with slight play within its axial guide.

The tappet that is noted above and is proposed as a rolling or sliding tappet could be activated, for example, by a cam on a drive side, wherein this cam sits on the end of a camshaft of a valve train of the internal combustion engine (pump tappet). However, it is also conceivable and provided to apply the lift-generating means on an arbitrary shaft of the internal combustion engine, such as a compensating shaft or crankshaft (pump tappet). In the case of a use of the tappet in a valve train of an internal combustion engine, this tappet could communicate with a cam of a camshaft lying above or below.

An assembly of the bridge part is conceivably simple. Thus, the production costs in large-series production can be reduced. Here, the bridge part with its radial extension running advantageously integrally on this part is guided forward past the driven-side end of the housing and inserted with its radial extension into the respective window. Then a snapping/locking of the bridge part takes place with its side diametrically opposite the radial extension by the projection extending from the inner casing of the housing and a contact on the bottom sides takes place by flat sections that are diametrically opposite in the housing.

The snap projection noted above could be generated, for example, by a simple stamping-embossing process. Optionally, a separate snap tab could also be applied. In addition, it is conceivable and provided to arrange several snap projections distributed on the periphery.

The flat sections noted last have a stiffening function and are used for an arrangement of a bolt, wherein a slide-supported or roller-supported roller runs on this bolt as a contact partner for the cam or eccentric.

The bridge part with the finger-like projection for realizing the anti-rotation device could be stamped, embossed, and bent from sheet-metal material. Alternative materials, such as plastics or composite materials are also optionally conceivable and provided. The top sides of the bridge part that contact bottom sides of the flat sections preferably follow the contours of the bottom sides mentioned last. Thus, the bridge part could have a slightly cylindrical construction, which also provides a contribution in the direction of stiffening.

The anti-rotation device projecting from the bridge part could be subjected to further treatment on its end side according to another proposal of the invention. For example, it is proposed to impart to the guide projection a greater guide length so that this is flattened, stretched, bent, embossed, or the like on the end side.

Another proposal provides for mounting a separate component, such as a pin or a tube section, in the end side of the radial extension of the bridge part. The components noted last could be connected, for example, by pressing, soldering, welding, etc. to the bridge part and could likewise increase the guide length in the groove during installation.

Finally, another subordinate claim concerns the fact that the housing is produced from an economical lightweight construction material, such as steel sheet metal, for example, using deep-drawing technology. In this way, a further contribution in the direction of lowering the costs is provided.

BRIEF DESCRIPTION OF THE DRAWINGS

The invention is preferably explained in detail with reference to the drawings. Shown are:

FIG. 3, an enlarged view of the inner casing of the tappet in the region of its projection, and FIGS. 4 to 7, the bridge part with alternative constructions of its radial extension.

DETAILED DESCRIPTION OF THE PREFERRED EMBODIMENTS

Figure 1:
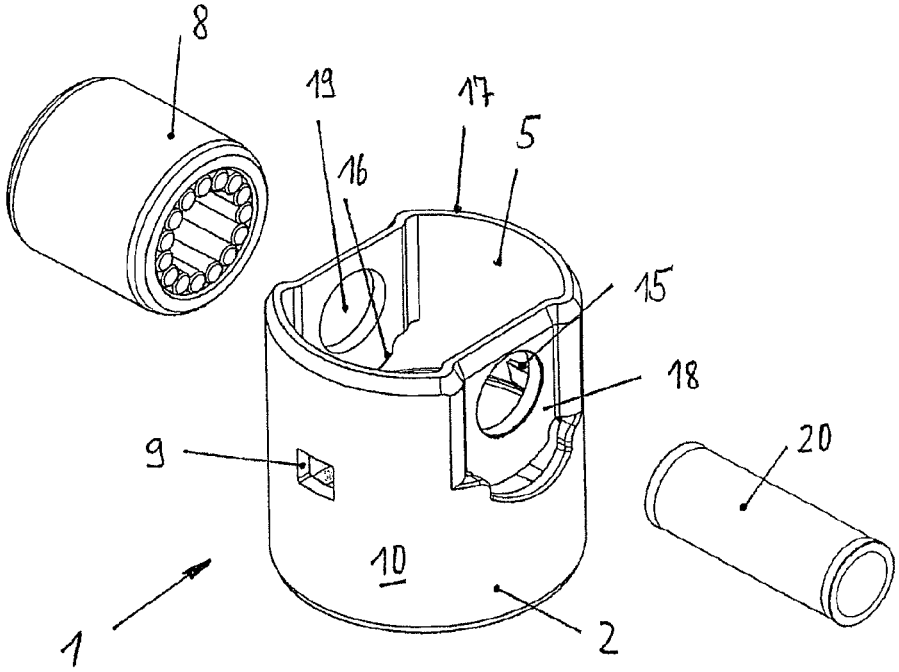
FIG. 1, the tappet according to the invention in an exploded view.
Figure 1:
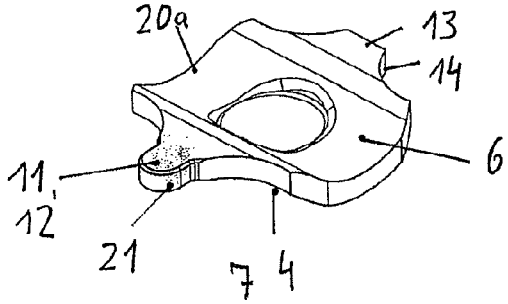
Figure 2:
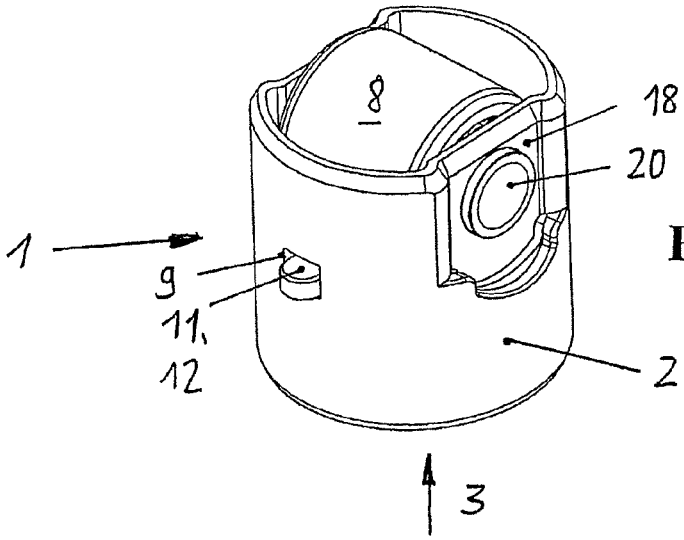
FIG. 2, the tappet according to FIG. 1 in an assembled view.

Shown is a tappet 1, here as a counter follower for a cam of a high-pressure fuel pump. The tappet 1 consists of an essentially cylindrical housing made from thin-walled steel sheet metal with a driven side 3 and a drive side 7. The housing 2 is bounded on its drive side 7 by a drive-side end 17. It has two diametrically opposite flat sections 18 extending up to this end 17. In each flat section 18, a bearing lug 19 is provided. As FIGS. 1, 2 disclose, on the ends in the bearing lugs 19 sits a bolt 20 on which a rolling bearing-supported roller 8 runs. The roller 8 communicates with a not-shown cam of a fuel pump.

In addition, it is shown that an inner casing 5 of the housing 2 is penetrated by a bridge part 6. The bridge part 6 is constructed as a thin-walled sheet metal component and has a finger-like radial extension 12 for the realization of an anti-rotation device 11.

The housing 2 has a window 9 through which the radial extension 12 of the bridge part 6 projects. Here, on one side, the bridge part 6 contacts bottom sides 16 of the flat sections 18 in the direction toward the drive-side end 17. On the other side, the bridge part 6 is snapped behind a projection 15 extending from the inner casing 5 of the housing 2 with an edge region 14 of a section 13 opposite the radial extension 12. The at least one projection 15 is realized, for example, by a stamping/embossing.

It is apparent that through the integral connection of the radial extension 12 with the bridge part 6 for the realization of the anti-rotation device 11 and through the simultaneously simple axial fixing of the bridge part 6 on the projection 15, as well as on the bottom sides 16 of the flat sections 18, an economical tappet 1 is created. Through the window engagement of the bridge part 6 and its support on the projection 15, a very simple securing arrangement is created for the bridge part 6. In addition, the tappet 1 is reduced with respect to its number of parts compared with tappets according to the prior art.

FIGS. 4 to 7 show special constructions of an outer end 21 of the radial extension 12. For example, according to FIG. 4, the outer end 21 could be flattened, so that a larger guide length is given. According to the construction according to FIG. 5, it is provided to attach a separate insert 23 to the outer end 21. Also, according to FIG. 6, the contact surface area for the guide groove in the surrounding material could be enlarged by a stretching process or, according to FIG. 7, by bending.

LIST OF REFERENCE SYMBOLS

1) Tappet
2) Housing
3) Driven side
4) Underside
5) Inner casing
6) Bridge part
7) Drive side
8) Roller
9) Window
10) Outer casing
11) Rotational locking device
12) Radial extension
13) Section
14) Edge region
15) Projection
16) Underside
17) Drive-side end
18) Flat
19) Bearing lug
20) Bolt
20*a*) Top side
21) Outer end
22) Guide shoulder
23) Insert part

The invention claimed is:

1. A tappet, either for a high-pressure fuel pump or for a valve train of an internal combustion engine, comprising a housing, having a roller or sliding surface incorporated in a drive side thereof used for a cam or eccentric catch and wherein a driven side used for a contact of a tappet follower lies on a bottom side of a bridge part extending through an inner casing of the housing, an anti-rotation device projects past an outer casing and is formed from a radial extension of the bridge part and extends into a window of the housing a projection that is produced by a stamping-embossing process and attached integrally is located on the inner casing of the tappet only on a section thereof diametrically opposite the window, the projection rises with a wedge shape in a direction toward the drive side, and the bridge part is made from steel sheet metal and is snapped, with a section thereof diametrically opposite the radial extension, over the projection and lies on the projection with an edge region of a bottom side thereof.

2. The tappet according to claim 1, wherein the bridge part contacts, in a direction toward the drive side, bottom sides of diametrically opposite flat sections formed in the outer casing of the housing and also extending from a drive-side end of the housing, each of the flat sections has a bearing lug, and a bolt for the rolling or sliding support of the roller is accommodated in the bearing lugs .

3. The tappet according to claim 2, wherein the bottom sides of the flat sections are present on the inner casing of the housing in the form of half shells, and a top side of the bridge part is complementary, at least in a section of the bottom sides of the flat sections, to the flat sections mentioned last.

4. The tappet according to claim 1, wherein the radial extension is finger-shaped, connected integrally to the bridge part, and transitions at an outer end into a guide projection extending at a right angle on one or two sides.

5. The tappet according to claim 4, wherein the guide projection is produced by one of flattening, embossing/stretching, or by bending.

6. The tappet according to claim 1, wherein the radial extension is provided on an outer end thereof with a separate insert part, which is a vertically standing pin or a tube.

7. The tappet according to claim 6, wherein the separate insert part is connected to the outer end by pressing, welding, adhesion, or soldering.

8. The tappet according to claim 1, wherein the housing comprises deep drawn or extruded steel sheet metal.

* * * * *